US007258056B2

(12) United States Patent
Guesnet et al.

(10) Patent No.: US 7,258,056 B2
(45) Date of Patent: Aug. 21, 2007

(54) DEVICE TO RECUPERATE THE ENERGY PRODUCED DURING THE RECOILING OF A WEAPON

(75) Inventors: Dominique Guesnet, Saint Germain du Puy (FR); Alain Charton, Crosses (FR)

(73) Assignee: Giat Industries, Versailles (FR)

( * ) Notice: Subject to any disclaimer, the term of this patent is extended or adjusted under 35 U.S.C. 154(b) by 394 days.

(21) Appl. No.: 10/814,138

(22) Filed: Apr. 1, 2004

(65) Prior Publication Data

US 2004/0216598 A1 Nov. 4, 2004

(30) Foreign Application Priority Data

Apr. 3, 2003 (FR) ..... 03 04163

(51) Int. Cl.
*F41A 25/00* (2006.01)

(52) U.S. Cl. ..... 89/43.01; 89/4.05; 89/12; 89/14.3

(58) Field of Classification Search ..... 89/43.01, 89/4.05, 12

See application file for complete search history.

(56) References Cited

U.S. PATENT DOCUMENTS 2,410,116 A * 10/1946 Vickers ..... 89/4.05
3,144,809 A * 8/1964 Girouard et al. ..... 89/4.05
3,146,672 A * 9/1964 Girouard et al. ..... 89/43.01
3,964,365 A 6/1976 Zielinski
4,046,056 A * 9/1977 Carrie ..... 89/12
4,296,670 A * 10/1981 Northup et al. ..... 89/43.01
5,042,360 A * 8/1991 Burmeister et al. ..... 89/12
5,495,788 A * 3/1996 Gorst ..... 89/4.1
6,536,324 B1 * 3/2003 Boissiere et al. ..... 89/14.3

FOREIGN PATENT DOCUMENTS

EP 0 403 452 A2 12/1990
EP 0 491 106 A1 6/1992

* cited by examiner

*Primary Examiner*—Michelle Clement
(74) *Attorney, Agent, or Firm*—Oliff & Berridge, PLC.

(57) ABSTRACT

A device to recuperate the energy produced during the recoiling of a weapon provided with a hydraulic fluid power circuit, wherein said device comprises an energy recuperating cylinder activated by the recoil of said weapon, a double-acting cylinder comprising two chambers separated by a piston, a first chamber of said cylinder being connected to said hydraulic power circuit of said weapon, said piston of said cylinder pushing said hydraulic fluid in said circuit into a storage accumulator when said weapon recoils. The energy recuperating cylinder comprises a second chamber connected to a recoil mechanism that ensures pressurising of said mechanism.

9 Claims, 5 Drawing Sheets

DEVICE TO RECUPERATE THE ENERGY PRODUCED DURING THE RECOILING OF A WEAPON

BACKGROUND OF THE INVENTION

1. Field of Invention

The technical scope of the invention is that of braking systems for an element in motion, for example a weapon during the recoil caused by firing a projectile, and which allow the energy thus developed to be recuperated.

2. Description of Related Art

Such devices are known and reference may be made to patent EP-0403452, which describes a device allowing the stored energy to be used to close the breach of a weapon. The device described only allows the energy to be used for a single type of to and fro movement such as, for example, that of the opening/closing of the breech, or else the ejection of thee stub. Generally speaking, the devices proposed do not allow the recuperated energy to be stored for possible use to other ends.

Moreover, known energy recuperators do not allow several networks to be powered.

The powering of a hydraulic network often requires a hydraulic generator of the engine and pump type whose bulk and mass are problematic and make them difficult to integrate into the frame of the weapon.

SUMMARY OF THE INVENTION

The aim of the invention is to propose an energy recuperation device that overcomes these drawbacks whilst allowing part of the recoil energy of the weapon to be recuperated and rendered according to the user's needs.

The invention thus relates to a device to recuperate the energy produced during the recoiling of a weapon, wherein it comprises an energy recuperating cylinder activated by the recoil of the weapon, a double-acting cylinder comprising two chambers separated by a piston, a first chamber of the cylinder being connected to a hydraulic power circuit of the weapon, the piston of said cylinder pushing the hydraulic fluid in this circuit into a storage accumulator when the weapon recoils.

According to one characteristic of the invention, the energy recuperating cylinder comprises a second chamber connected to a recoil mechanism that ensures its pressurising.

According to another characteristic of the invention, the recuperating cylinder incorporates a rod integral with the piston, such rod pushed by the weapon during its counter recoil.

According to another characteristic of the invention, the energy recuperating cylinder is connected to the weapon's hydraulic power circuit by means of main piping divided into at least two secondary pipings provided with first and second valves allowing the passage of a fluid in one direction only, one secondary piping connecting the main piping to the storage accumulator and another secondary piping connecting the main piping to a supercharging accumulator.

According to another characteristic of the invention, the first valve is placed between the supercharging accumulator and the main piping, and the second valve is placed between the main piping and the storage accumulator, the first valve being closed and the second valve open when the weapon recoils.

The storage accumulator may supply the weapon's hydraulic network with pressurised fluid via service piping.

According to a variant embodiment of the invention, the second chamber of the recuperating cylinder is connected to the nitrogen chanter of the recoil mechanism.

According to another variant embodiment of the invention, the second chamber of the recuperating cylinder is connected to the recoil mechanism via an oil circuit delimited on the nitrogen chamber side of the recoil mechanism by a free piston which separates the nitrogen and the oil circuit.

According to another variant embodiment of the invention, the second chamber of the recuperating cylinder is connected to the oil chamber of the recoil mechanism.

BRIEF DESCRIPTION OF THE DRAWINGS

Other characteristics, particulars and advantages of the invention will become more apparent from the additional description given hereafter by way of illustration and in reference to the appended drawings, in which.

DETAILED DESCRIPTION OF PREFERRED EMBODIMENTS

Figure 1:
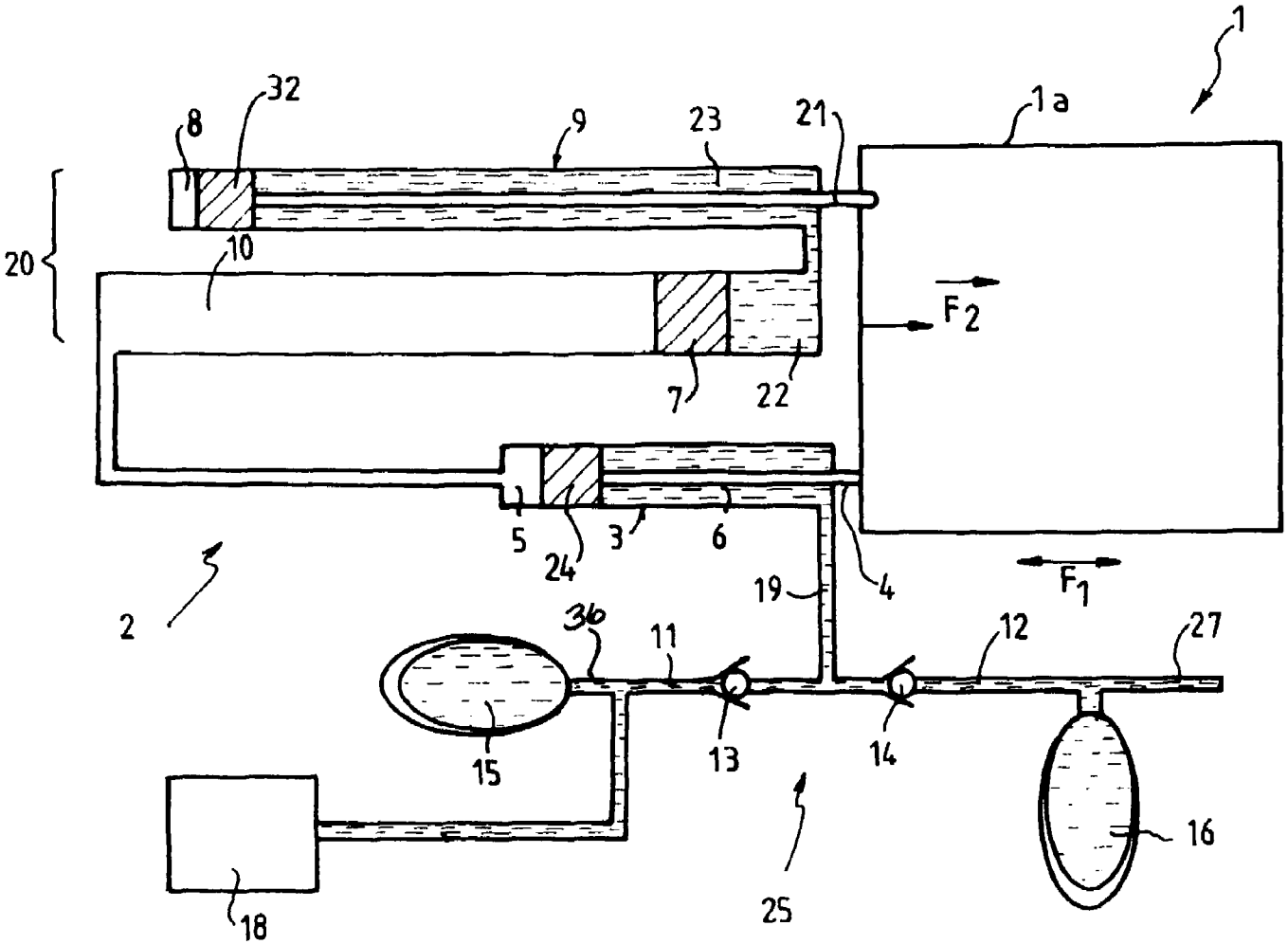
FIG. 1 schematically illustrates the device according to the invention in its static phase, FIG. 2 schematically illustrates the device according to the invention in its recoil phase, that is, in its energy accumulation phase, FIG. 3 schematically illustrates the device according to the invention in the counter recoil phase, that is, in the supercharging phase of the energy recuperating cylinder, FIG. 4 schematically illustrates a first variant embodiment of the invention, and FIG. 5 schematically illustrates a second variant embodiment of the device according to the invention.

The upper part of FIG. 1 shows a weapon 1 whose recoil mass 1*a* is partially schematised. Each time the weapon is fired, and in a known manner, the weapon 1 performs a to and fro motion following arrow F1. This weapon 1 is attached to a recoil mechanism 20 comprising a first cylinder 9 whose rod 21 is integral with the recoiling mass of the weapon and a nitrogen chamber 10. The rod 21 is integral with a piston 32 sliding in the cylinder 9 and delimiting chambers 8 and 23. The nitrogen chamber 10 is limited by a free piston 7 that is also subjected to the action of a fluid in the cylinder 9 by means of a chamber 22. When the weapon recoils after firing a round, the weapon moves rapidly in the direction of arrow F2. In a known manner, the fluid in cylinder 9 passes through a calibrated opening and supplies chamber 22 thereby causing the nitrogen contained in chamber 10 to be compressed by means of the free piston 7. The recoil movement of the weapon is, moreover, rapidly braked thanks to a recoil brake (not shown) coupled with the recoil mechanism 20.

The nitrogen compressed in chamber 10 exerts a pressure on piston 7, which, after recoil, causes the counter recoil of the recoiling mass 1*a*, and the return of the rod 21 to its starting position.

According to the invention, an energy recuperating device 2 is provided that is connected to the nitrogen chamber 10 and activated by the weapon's recoil. This device is shown in the lower part of FIG. 1. To this end, the device comprises an energy recuperating cylinder 3, comprising a piston 24 sliding in the cylinder body 3 and integral with a rod 4 pressing at one end against the recoiling mass 1*a* of the weapon 1.

This piston 24 delimits a first chamber 6 and a second chamber 5. The second chamber 5 of the cylinder 3 communicates with the nitrogen chamber 10 and thus also contains nitrogen. The first chamber 6 communicates with a fluid accumulator assembly 25.

The assembly 25 firstly comprises a supercharging accumulator 15 and secondly a storage accumulator 16. The accumulator 15 may be supplied with oil by piping 36 bringing the oil back from the different actuators of the hydraulic circuit (not shown). The accumulator may also be supplied using a pump motor 18. The supercharging accumulator 15 is a low pressure accumulator (pressure at around $3.10^5$ Pa to $10^6$ Pa).

The storage accumulator is in the form of a pressurised oil tank intended to supply one or several apparatus (not shown) by means of service piping 27.

The storage accumulator 16 is a high pressure accumulator (pressure at around $1.5.10^7$ Pa to $2.5.10^7$ Pa).

The chamber 6 of the cylinder 3 communicates with the assembly 25 by main piping 19 that is divided into two branches 11 and 12 each provided with a non-return valve, respectively 13 and 14. Valve 13 only allows the passage of compressed fluid from the supercharging accumulator 15 towards the cylinder 3. Valve 14 only supplies the storage accumulator 16 with compressed fluid via a piston 3 (the low pressure of the supercharging accumulator 15 always being lower than the high pressure of the storage accumulator 16).

The compressed fluid may classically be oil. Each accumulator 15 or 16 will classically incorporate a gas chamber, not shown, isolated from the fluid by means of a membrane and allowing the accumulator to become pressurised.

Figure 2:
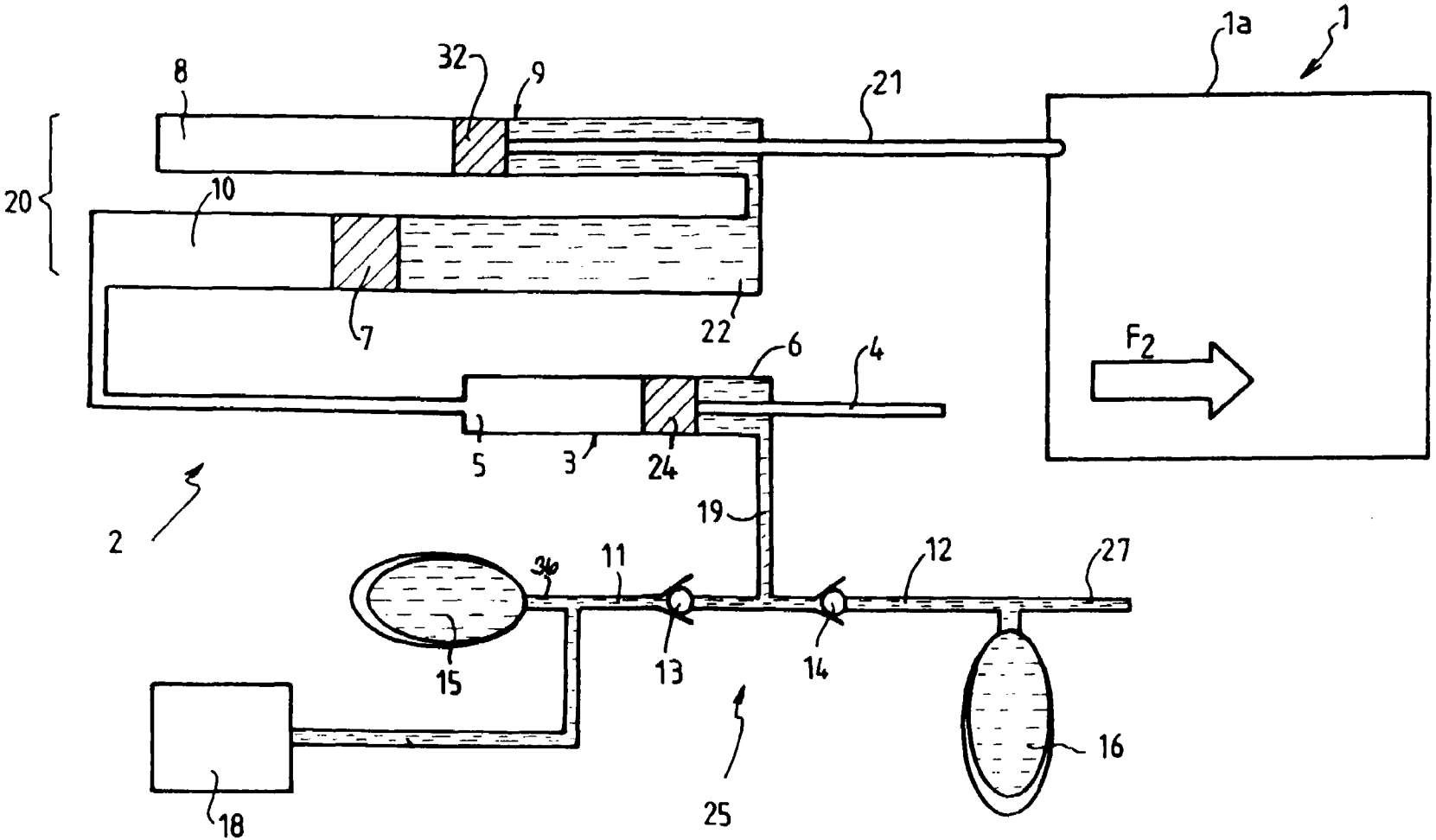

FIG. 2 shows the device according to the invention during an intermediate step in the recoil phase of the weapon, that is, during the energy recuperation phase, the end position of the weapon not being shown since superfluous to understanding the operation.

The recoiling mass of the weapon 1 has recoiled a certain distance following arrow F2 driving with it the rod 21 of the cylinder 9. The recoil mechanism 20 fulfils its function and the fluid contained in chamber 23 is pushed back into chamber 22 thereby causing the nitrogen contained to chamber 10 to be compressed. The pressure of the nitrogen in chamber 5 increases concomitantly and pushes the piston 24 of the recuperators 3, thereby pushing back the oil contained in the first chamber 6. This pressurised oil is conducted by means of the valve 14, into the high pressure storage accumulator 16. Thus, part of the energy produced by the weapon's recoil has been recuperated. This energy is available in the accumulator 16 to be used at any time, for example by means of piping 27.

Figure 3:
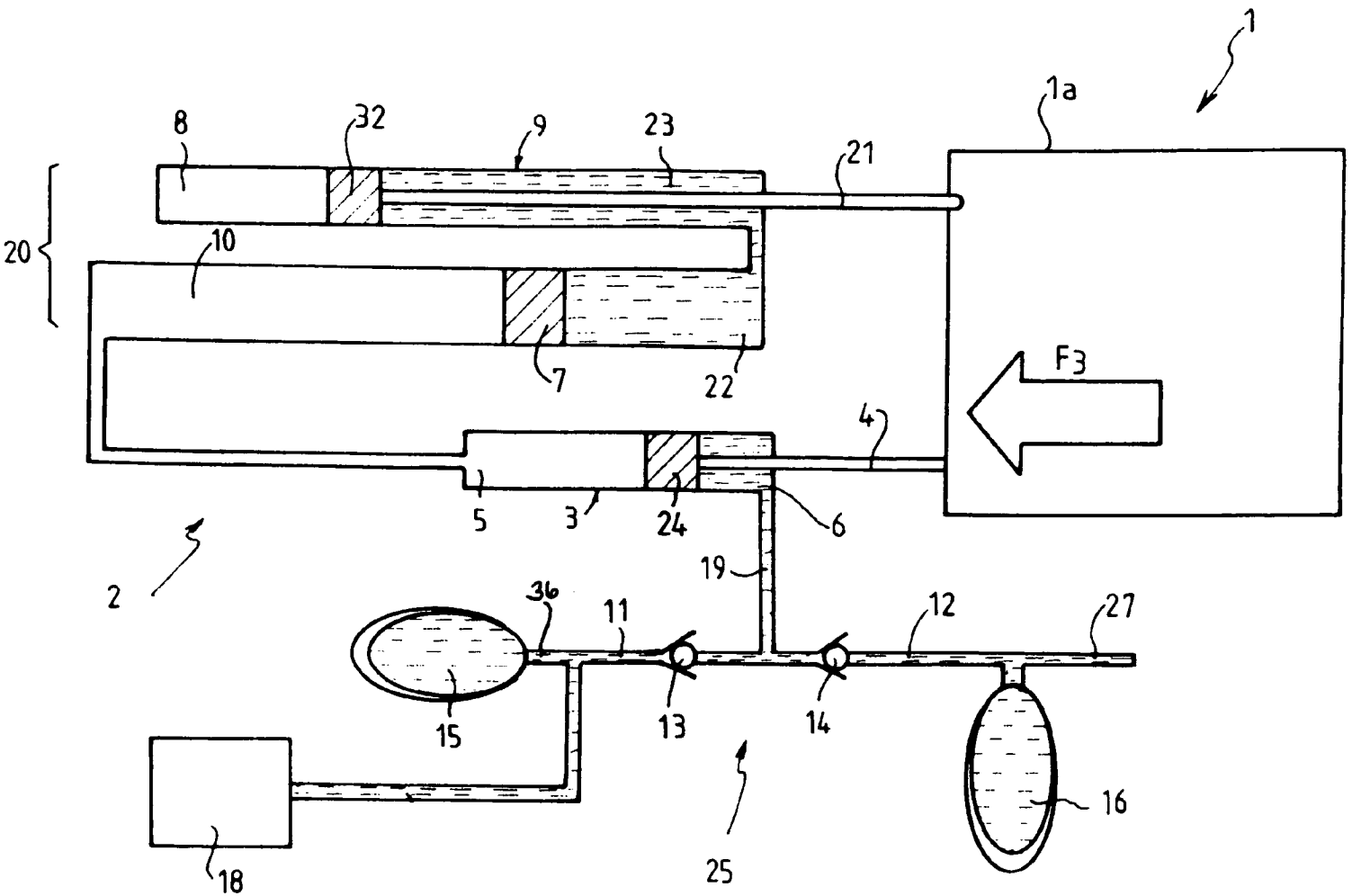

FIG. 3 shows the device according to the invention during the counter recoil phase of the weapon. It is the pressure of the nitrogen contained in the chamber 10 which, as succinctly explained above, causes this counter recoil movement of the weapon. The recoiling mass of the weapon 1 therefore pushes the rod 4 of the cylinder 3 (and thus the piston 24) bringing it back into its starting position as shown in FIG. 1. This return movement of the piston 24 causes a depressurising of the oil in the main piping 19 resulting in the opening of valve 13 and the supercharging accumulator 15 ensures the first chamber 6 of the cylinder 3 is filled with oil. The valve 14 remains closed by the high pressure of the storage accumulator 16 which is greater than the pressure supplied by the supercharging accumulator 15.

Figure 4:
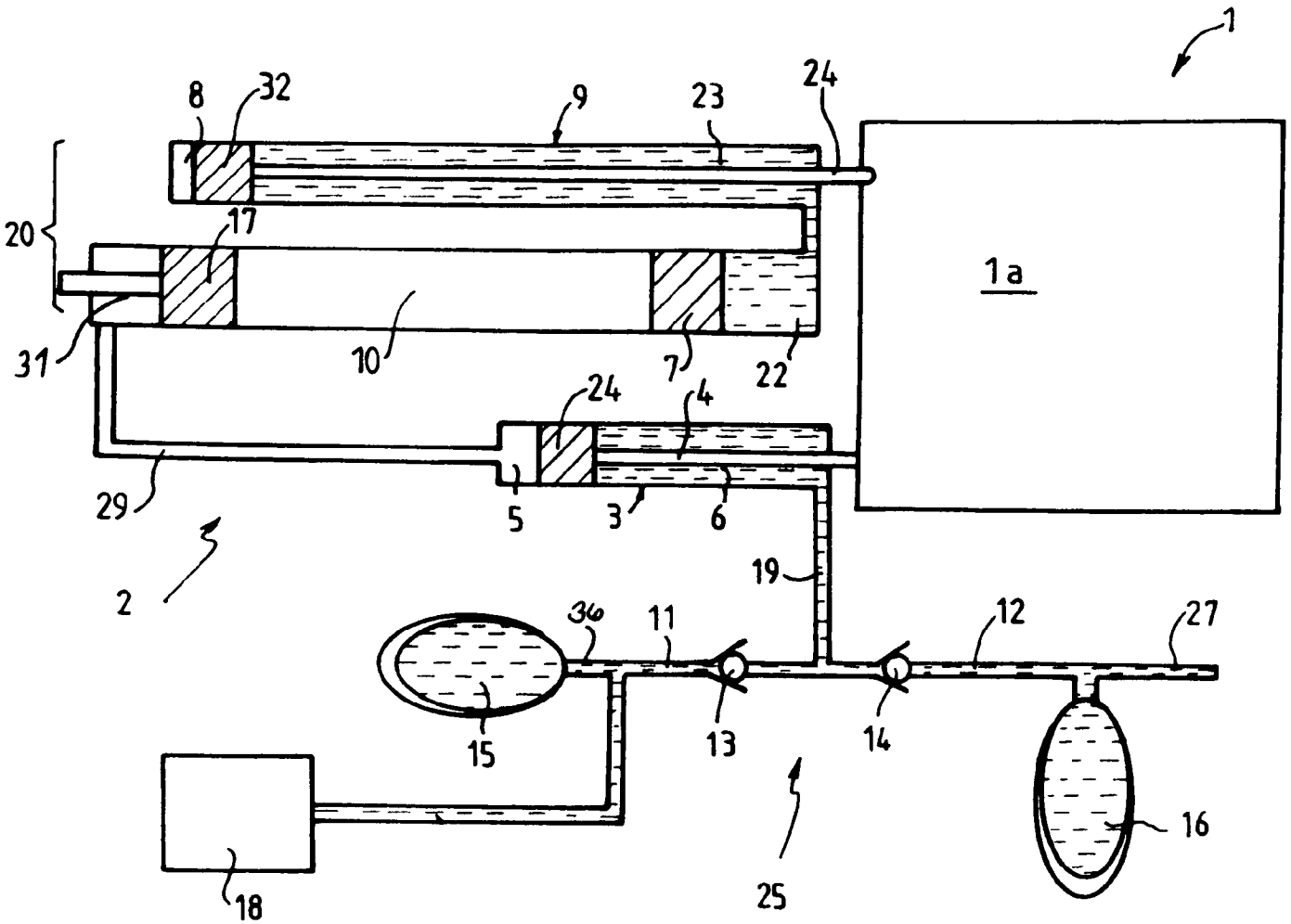

FIG. 4 illustrates a variant embodiment of the recuperator device according to the invention.

In this example, the second chamber 5 of the recuperating cylinder 3 is connected to the recoil mechanism 20 by means of an oil circuit comprising piping 29. This oil circuit is delimited on the, nitrogen chamber 10 side of the recoil mechanism 20 by a second free piston 17 that isolates the nitrogen and the oil circuit.

The chamber 10 containing the nitrogen no longer communicates with the second chamber 5 of the recuperating cylinder 3.

The piston 17 carries a rod 31 whose protrusion from the recoil mechanism 20 allows the oil replenishment level of the system to be visualised. The operating principle remains globally the same, the nitrogen pressure in this case being applied to the piston 24 of the recuperating cylinder 3 by means of another fluid.

This embodiment offers the advantage of being safer. Indeed, should the piping 29 rupture accidentally, there would be no leakage of nitrogen and the recoil mechanism 20 would remain operational. Firing would still be possible.

Figure 5:
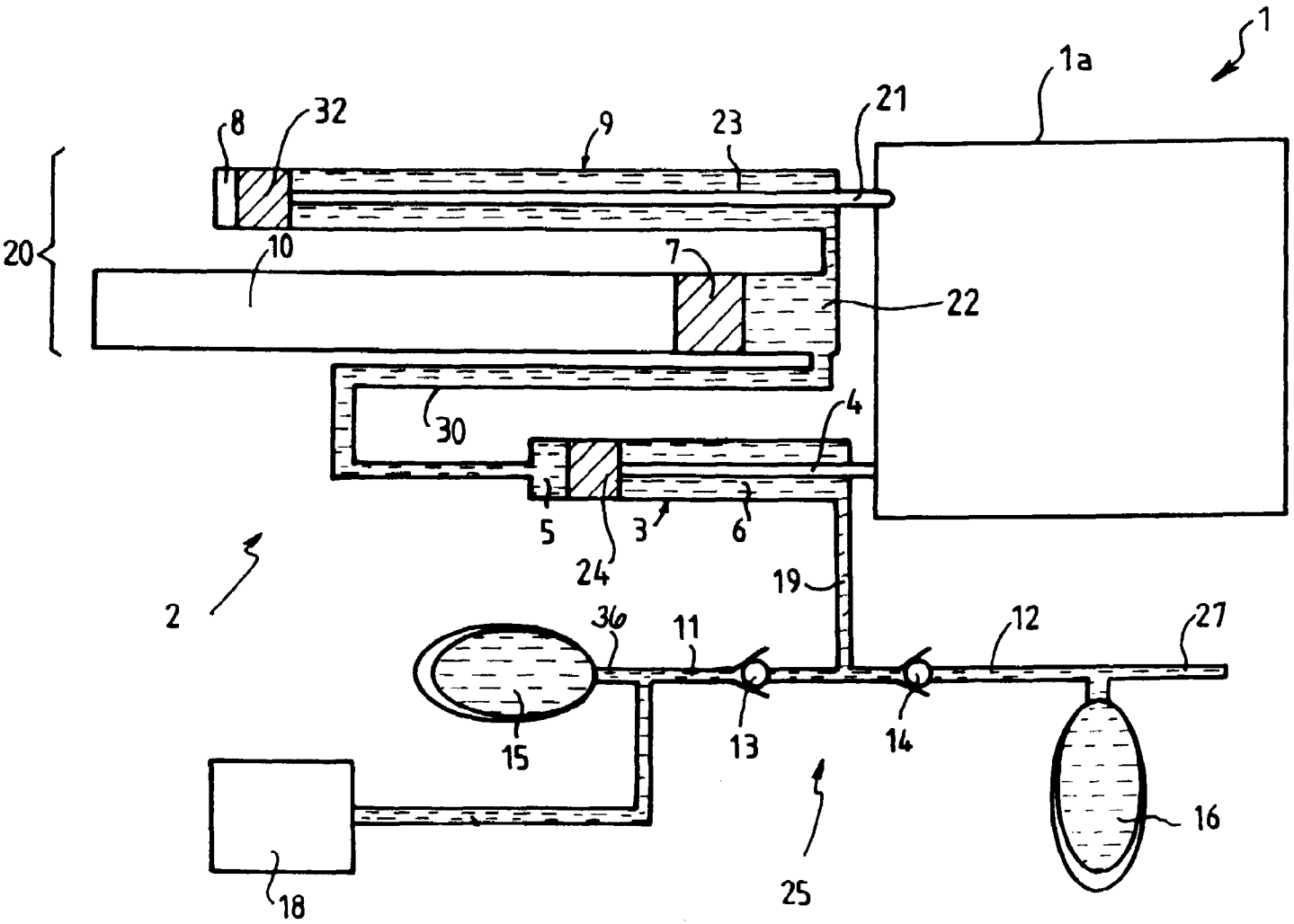

FIG. 5 shows another variant embodiment of the recuperation device according to the invention.

In this example, the second chamber 5 of the recuperating cylinder 3 is connected to the oil chamber 22 of the recoil mechanism 20 of the weapon by means of piping 30. Thus, when the weapon 1 recoils, the oil is pushed from chamber 23 to chamber 22 and thus towards the second chamber 5 of the recuperating cylinder 3. During the counter recoil phase, the nitrogen pressure in the chamber 10 causes the counter recoiling of the weapon's recoiling mass. The recoiling mass pushes back the rod 4 and the resulting depressurising of the oil in the main piping 19 causes the circuit to be resupplied with oil by the supercharging accumulator 15. Other variants are naturally possible without departing from the scope of the invention.

In all the above Figures, the hydraulic circuit is shown schematically. The relative dimensions and proportions of the different components are thus not respected.

Naturally, this circuit also comprises the usual control and safety organs such as manometers and pressure control valves.

What is claimed is:

1. A device to recuperate energy produced during a recoiling of a weapon provided with a hydraulic fluid power circuit, wherein said device comprises:

an energy recuperating cylinder, activated by the recoil of said weapon, comprising two chambers separated by a piston;

wherein a first chamber of said cylinder being connected to said hydraulic fluid power circuit of said weapon, said piston of said cylinder pushing hydraulic fluid in said circuit into a storage accumulator when said weapon recoils; and wherein during a counter recoiling of said weapon, said cylinder is pushed in a direction of the counter recoil.

2. A device according to claim 1, wherein said energy recuperating cylinder comprises a second chamber connected to a recoil mechanism that ensures pressurising of said mechanism.

3. A device according to claim 2, wherein the energy recuperating cylinder incorporates a rod integral with said piston, said rod pushed by said weapon during the counter recoil.

4. A device according to claim 3, wherein said energy recuperating cylinder is connected to the hydraulic fluid power circuit by means of a main piping divided into at least two secondary pipings provided with first and second valves allowing passage of a fluid in one direction only, one of said secondary pipings connecting said main piping to said storage accumulator and the other one of said secondary piping connecting said main piping to a supercharging accumulator.

5. A device according to claim 4, wherein said first valve is placed between said supercharging accumulator and said main piping, and said second valve is placed between said main piping and said storage accumulator, said first valve being closed and said second valve open when said weapon recoils.

6. A device according to claim 5, wherein said storage accumulator supplies said hydraulic fluid power circuit with pressurised fluid via a service piping.

7. An energy recuperation device according to claim 6, wherein said second chamber of said recuperating cylinder is connected to a nitrogen chamber of said recoil mechanism.

8. An energy recuperation device according to claim 6, wherein said second chamber of said recuperating cylinder is connected to said recoil mechanism via an oil circuit delimited on a nitrogen chamber side of said recoil mechanism by a free piston which separates nitrogen and said oil circuit.

9. An energy recuperation device according to claim 6, wherein said second chamber of said recuperating cylinder is connected to said oil chamber of said recoil mechanism.

* * * * *